US005152569A

United States Patent [19]

Guiboche

[11] Patent Number: 5,152,569

[45] Date of Patent: Oct. 6, 1992

[54] LITTER PICKING TOOL

[76] Inventor: Thomas Guiboche, 4-301 Marion Street, Winnipeg, Manitoba, Canada, R2H 0V1

[21] Appl. No.: 734,140

[22] Filed: Jul. 22, 1991

[51] Int. Cl.[5] ..... B66C 3/16

[52] U.S. Cl. ..... 294/106; 294/99.2

[58] Field of Search ..... 294/106, 99.2, 50.8, 294/119, 115

[56] References Cited

U.S. PATENT DOCUMENTS

| | | | |
|---|---|---|---|
| 3,202,449 | 8/1965 | Lemelson | 294/106 X |
| 3,264,028 | 8/1966 | Rasmussen . | |
| 3,527,492 | 9/1970 | Hollis . | |
| 3,531,836 | 10/1970 | Crickmer | 294/902 X |
| 3,692,347 | 9/1972 | Bixler | 294/99.2 X |
| 3,904,234 | 9/1975 | Hill et al. | 294/106 |
| 4,079,765 | 3/1978 | Hatayan | 294/99.2 X |
| 4,160,563 | 7/1979 | Whitney . | |
| 4,165,745 | 8/1979 | Heifetz | 294/99.2 X |
| 4,192,204 | 3/1980 | Feldman | 294/99.2 X |
| 4,192,539 | 3/1980 | Broyles et al. . | |
| 4,343,590 | 8/1982 | D'Aloisio | 294/106 X |
| 4,398,759 | 8/1983 | Manola . | |
| 4,441,746 | 4/1984 | Corboy, Jr. . | |
| 4,456,293 | 6/1984 | Panissidi | 294/106 |
| 4,506,669 | 3/1985 | Blake, III | 294/99.2 X |
| 4,540,212 | 9/1985 | Inaba et al. | 294/106 X |
| 4,615,555 | 10/1986 | Bateham . | |
| 4,783,926 | 11/1988 | McKinney et al. . | |

*Primary Examiner*—Margaret A. Focarino
*Assistant Examiner*—Joseph D. Pape
*Attorney, Agent, or Firm*—Adrian D. Battison; Stanley G. Ade; Murray E. Thrift

[57] ABSTRACT

A picking tool for litter and the like includes a handle with a manually graspable upper end and jaw elements at the lower end which can be opened and closed by operating the handle to grasp material to be lifted. The handle includes two generally parallel handle sections which can be squeezed together by manual operation at the upper end. The squeezing action operates on a pair of gear tooth fulcrum members at the lower which are thus pivoted open by the squeezing action. Each fulcrum member can replacably receive a jaw element for grasping the material between the two jaw elements. One style of jaw element comprises a scoop. A second style of jaw element includes an outer pinch edge and a pair of receptacles rearwardly of the pinch edge for collecting materials of different sizes.

8 Claims, 4 Drawing Sheets

LITTER PICKING TOOL

BACKGROUND OF THE INVENTION

This invention relates to a pickup tool for use manually by an operator in picking up litter, garbage and other materials from the ground without bending.

Various designs of litter picking tools are provided and have been proposed in the patent literature. In many cases the device includes a handle with a manually graspable portion at the upper end of the handle and a pair of tongs at the lower end of the handle one of which is pivotally mounted on the handle and the other which is generally fixed with a pivotal portion being actuable by a lever or other system which is pulled manually at the upper end. However in many cases the operation is awkward and may require two hands. In other cases the design is poor and does not lend itself to effective and inexpensive manufacture. In most cases the grasping elements forming the tongs at the lower end simply comprises a pair of blades which come together at a pinch line at an edge at the end of the blade. Devices of this type are suitable for picking up only litter in the form of paper or fabric and cannot be used for other materials of a more solid nature.

In addition the device cannot in any way be modified to pickup other types of materials which require a scoop or receptacle to collect the material effectively.

SUMMARY OF THE INVENTION

It is one object of the present invention, therefore, to provide an improved pickup tool for litter and other materials.

According to the first aspect of the invention there is provided a pickup tool comprising an elongate handle having an upper and a lower end, manually graspable means at the upper end, jaw means mounted at the lower end including a first and a second jaw element and means coupling the jaw elements for relative movement in a direction transverse at a longitudinal extent of the handle for closing and opening movements of the jaw elements for grasping and releasing material to be picked up, and means movable at the manually graspable means for actuating said relative movement of the jaw elements, said movable means comprising two elongate substantially parallel sections of the handle each extending from the upper end to the lower end and coupled at the upper end such that squeezing of the handle sections at the upper end causes the lower ends of the handle sections to be forced together, fulcrum means interconnecting the lower end of a respective one of the handle sections to a respective one of the jaw elements such that said squeezing causes said opening movement of the jaw elements, and spring biasing means biasing said jaw elements to the closing movement.

According to the second aspect of the invention there is provided a pickup tool comprising an elongate handle having an upper and a lower end, manually graspable means at the upper end, jaw means mounted at the lower end including a first and a second jaw element and means coupling the jaw elements for relative movement in a direction transverse at a longitudinal extent of the handle for closing and opening movements of the jaw elements for grasping and releasing material to be picked up, and means movable at the manually graspable means for actuating said relative movement of the jaw elements, each of the jaw elements being mounted on a respective one of the fulcrum members in a readily replacable manner, said jaw element and said fulcrum member having means thereon for readily releasable coupling therebetween.

According to a third aspect of the invention there is provided a pickup tool comprising an elongate handle having an upper and a lower end, manually graspable means at the upper end, jaw means mounted at the lower end including a first and a second jaw element and means coupling the jaw elements for relative movement in a direction transverse at a longitudinal extent of the handle for closing and opening movements of the jaw elements for grasping and releasing material to be picked up, and means movable at the manually graspable means for actuating said relative movement of the jaw elements, each of the jaw elements including a material engaging surface with the material engaging surfaces arranged to face one another for clamping the material therebetween, each material engaging surface including an abutment edge at an outer most location thereon for defining a narrow pinch line between the elements, a first recessed receptacle surface extending from the edge to a second edge closer to the handle and parallel to the abutment edge and a second recessed receptacle surface larger than the first surface and extending from the second edge to the third edge adjacent to the handle and parallel to the abutment edge, whereby a smaller article can be grasped between the first receptacle surfaces and a larger article can be grasped independantly between the second surfaces.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
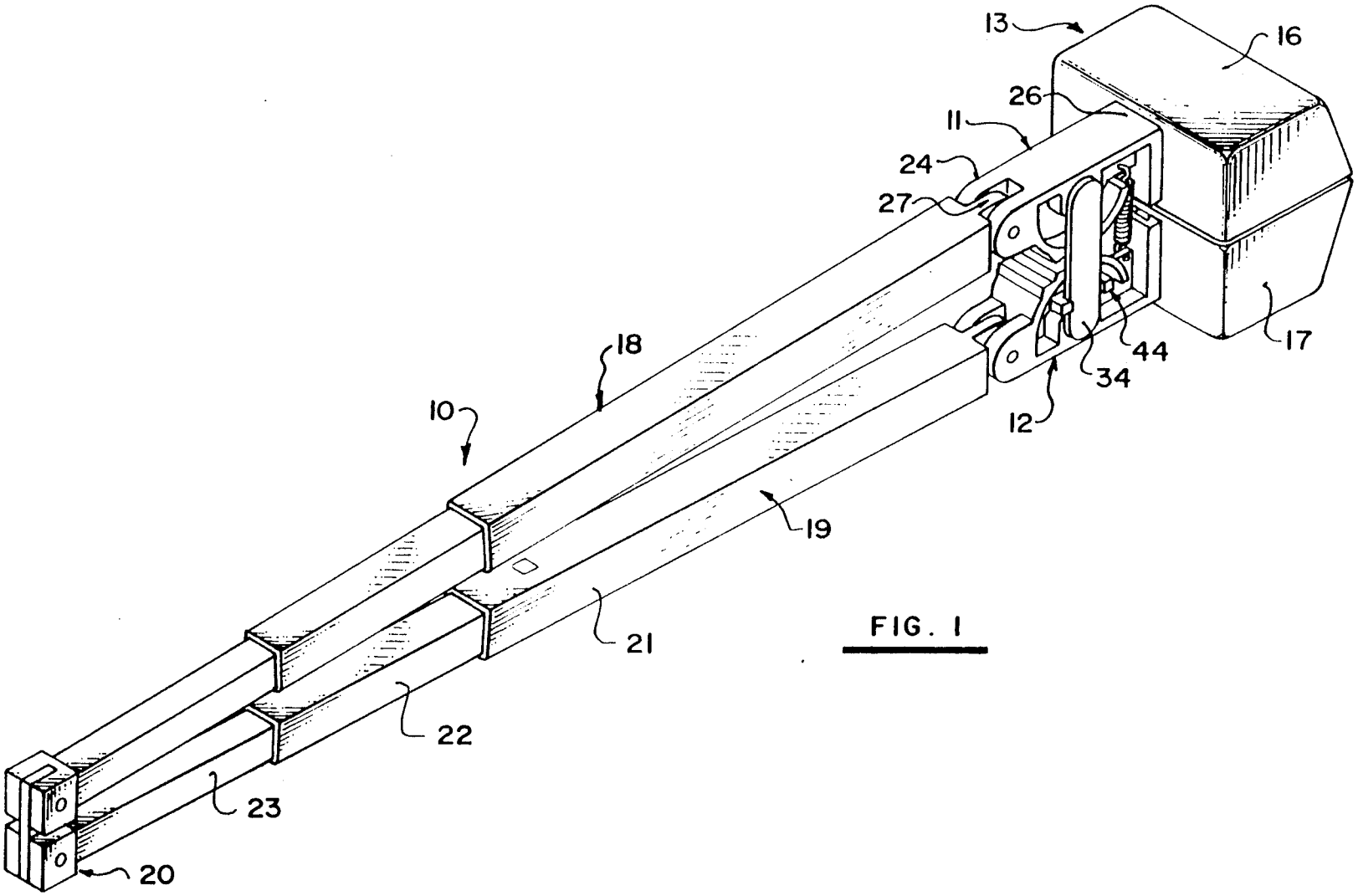
FIG. 1 is an isometric view of the picking tool according to the present invention in an extended condition of the handle and with the scoop attachment provided at the jaw end of the handle.
Figure 2:
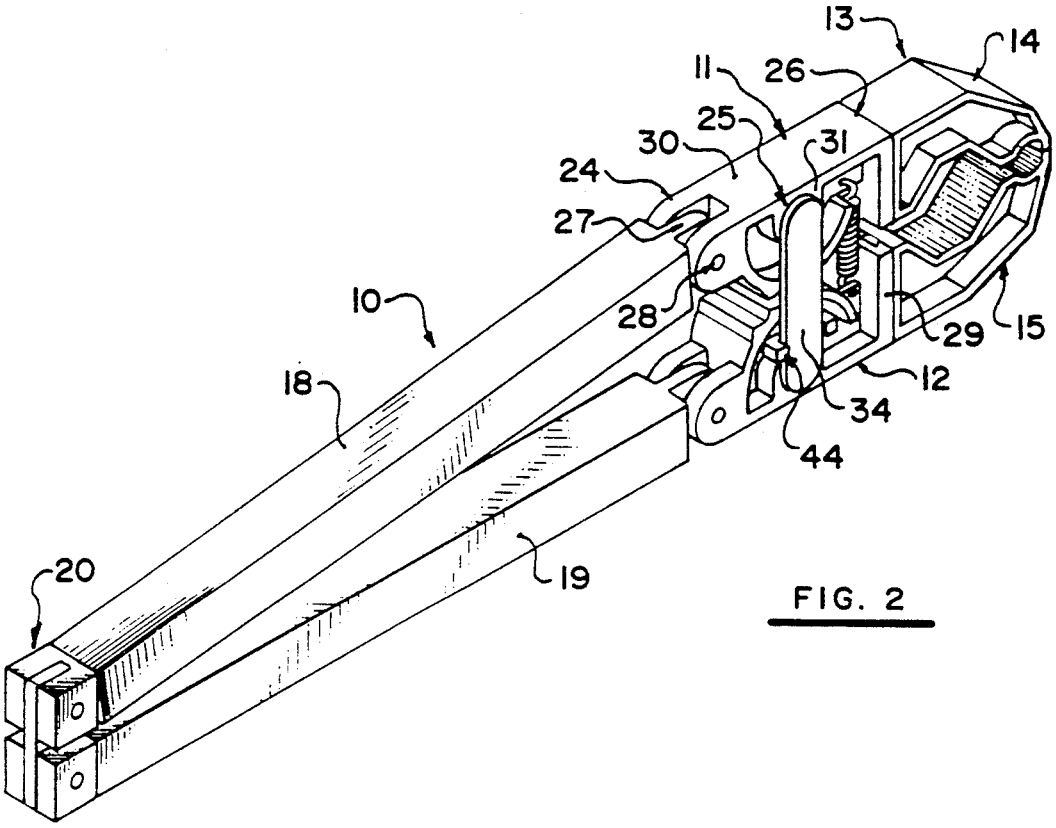
FIG. 2 is a similar isometric view of that of FIG. 1 showing a jaw attachment at the jaw end of the handle and showing the handle in retracted condition.

The pickup tool as shown in FIGS. 1 and 2 comprises generally a handle section indicated at 10, a pair of fulcrum members 11 and 12 and jaw section generally indicated at 13. As described hereinafter the jaw section can be readily removed and replaced so that the tool will be supplied with both a jaw arrangement including jaw elements 14 and 15 as shown in FIG. 2 and a scoop arrangement including scoop elements 16 and 17 as shown in FIG. 1.

The handle 10 includes a pair of handle section elongate members connected at upper ends by a pivotal coupling 20. The upper ends of the handle sections are pivotal relative to the coupling 20 so that the two handle sections can be squeezed together by manually grasping the two handle sections at the upper end and by applying an inward force tending to reduce the distance between the handle sections thus causing each to be pivoted relative to the coupling 20.

The handle sections can be formed as simple lightweight tubes which, as shown, can be of square cross section. The tubes are formed as three coaxial tube sections 21, 22 and 23 which can slide each inside the next to form a telescopic extension for increasing and decreasing the length of the handle as required. In FIG. 2 the handle is shown at the minimum length. In FIG. 1 the handle is shown at maximum length. In both cases the handle is grasped manually at the position immediately adjacent the coupling 20 and a squeezing action in both cases pushes the two handle sections 18 and 19 together.

The fulcrum members 11 and 12 each comprise an upper end portion 24, a central pivot section 25 and a lower end 26. The upper end 24 is in the form of a clevice for receiving an end portion 27 of the respective one of the handle sections projecting between the fork of the clevice to allow pivotal movement of the fulcrum member about a pin 28.

The lower portion 26 terminates in an end plate 29 extending generally at right angles to the length of the handle. The end plate 29 is coupled to the upper end 24 by a back plate 30 lying at right angles to the plate 29.

Upstanding from the back plate 30 is provided a boss 31 which receives a pin 32 of a transverse coupling member 34 acting to hold the fulcrum members at a required spaced relation.

The central section 25 includes an arcate surface 33 coaxially surrounding the centre of the pin 32 and facing toward the cooperating arcate surface of the opposed fulcrum member. On the arcate surface is defined a plurality of 45° gear teeth 35 extending transversely to the surface that is parallel to the axis of the pin 32. The teeth 35 thus are arranged in meshing relationship so that the surfaces 33 act in the form of a gear causing each to rotate about the pin 32 as the upper end 24 is forced inwardly by the squeezing action on the handle sections.

For convenience of manufacture by molding, the plate 29, the back plate 30, the clevice 24 and the surface 33 are all formed at a common width equal to the full width of the fulcrum member. Reinforcing sections inbetween these surfaces are reduced to a single thin web 36. The web 36 at a position between the outer end of the arcate surface 33 and the end plate 29 includes an opening 37 for receiving a hooked end of a spring 38 acting to bias the end plates 29 together and thus to bias the handle sections apart.

The end plates 29 act to support a selected one of the jaw elements to be attached thereto. An outer surface of the plate 29 therefore includes a pair of slots or channels 39 extending therealong in a direction parallel to the direction of movement of the plate 29 in the opening and closing action. An end of each of the slots 39 is defined by an abutment wall 40 at the edge of the end plate 29 adjacent the plate 30.

Each of the jaw elements to be attached to the picker operating handle system includes a pair of parallel projections 41 extending along an end plate 42 thereof for engagement with the slots 39 in the plate 29. The jaw elements can thus be engaged with the fulcrum member by pivoting the fulcrum members to the open position and then sliding the jaw element from an inner end 29A of the plate outwardly toward the abutment 40 until the jaw element is fully received within the slot as a press fit.

Figure 7:
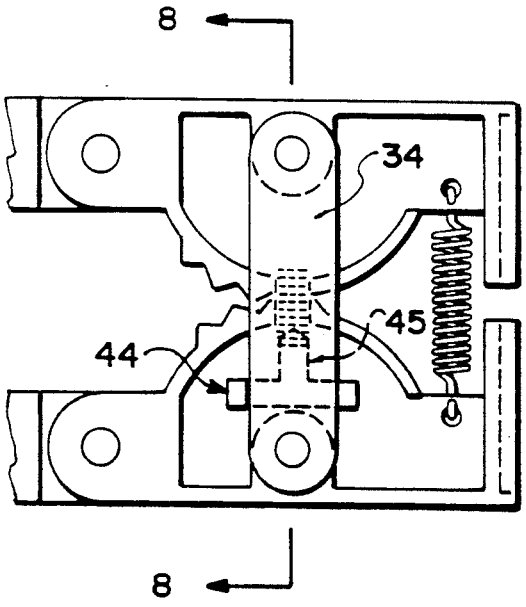
FIG. 7 is a side elevational view similar to FIG. 5 showing a lock system.
Figure 8:
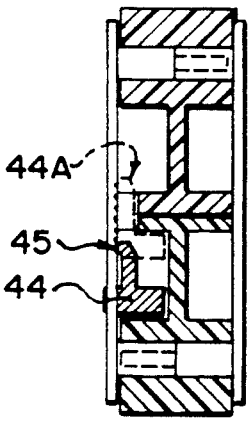
FIG. 8 is a view along the lines 8—8 of FIG. 7.

As shown in FIGS. 7 and 8, the coupling plate 34 includes a lock mechanism 44 which can move from an unlocked position shown in full line to a locked position shown in dash line at 44A in which a pin 45 projects into an opening in the surfaces 33 to hold the fulcrum members against pivotal movement in the closed position.

Figure 5:
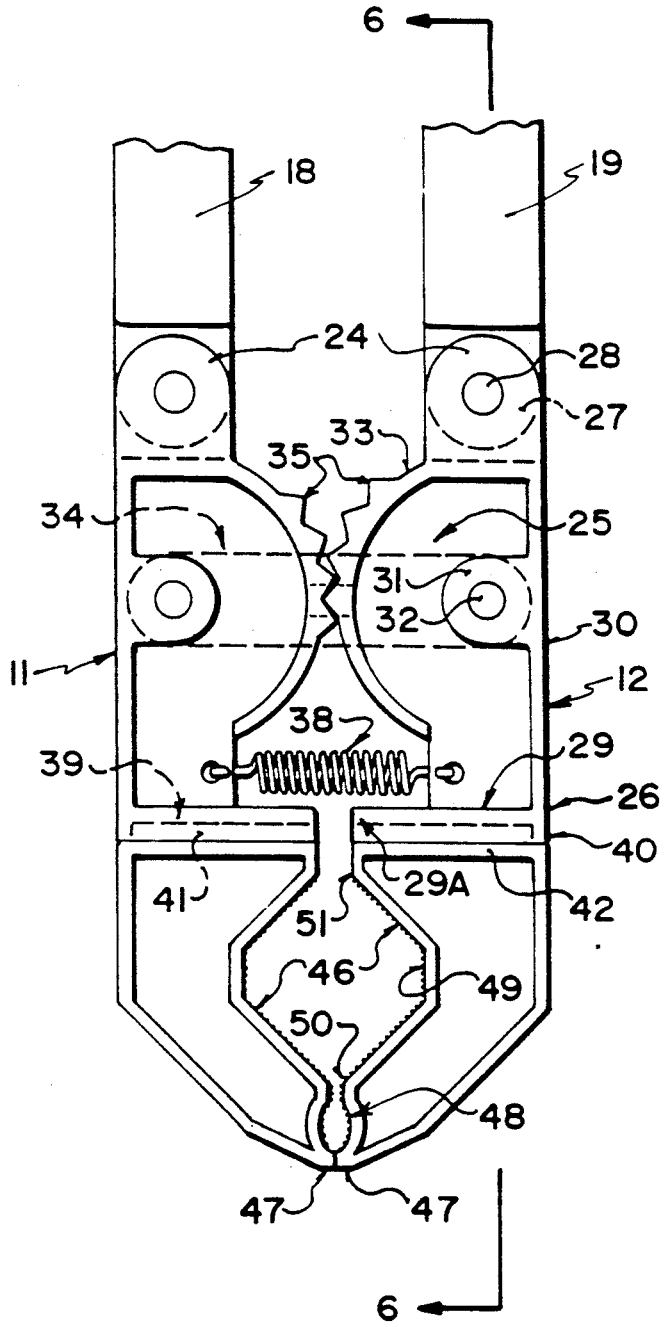
FIG. 5 is a front elevational view of the tool as shown in FIG. 2 again showing only the lower end of the handle.
Figure 6:
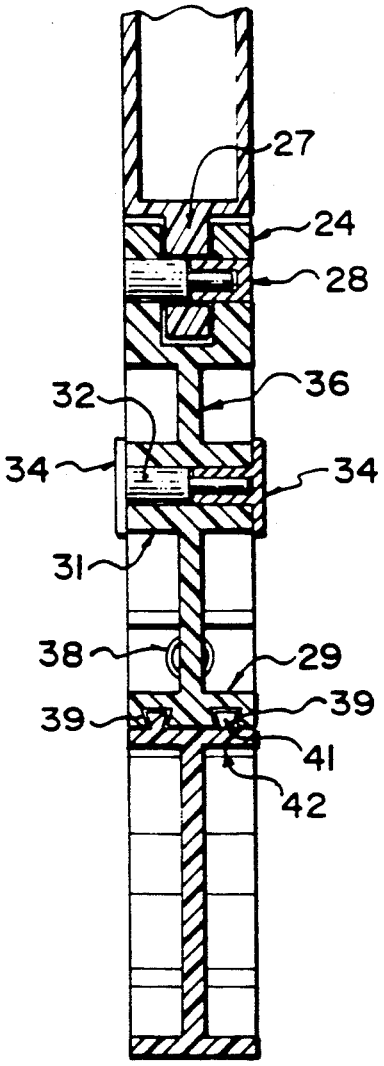
FIG. 6 is a cross sectional view along the lines 6—6 of FIG. 5.

One style of jaw element is shown in FIGS. 2 and 5 and includes a surface generally indicated at 46 for engaging an object or material to be lifted and grasped by the jaw element. The surface 46 includes an abutment edge 47 at an outermost end thereof for engaging a cooperating edge 47 of the opposing jaw element thus forming a nip line therebetween for pinching or grasping fabric, paper or the like. Immediately rearwardly of the edge 47 is provided a smoothly curved recess portion 48 which is recessed away from the nip edge 47 to define a substantially cylindrical receptacle between the surfaces 46 for picking up small articles of a dimension to fit into the cylindrical receptacle thus formed. The surface 46 includes a yet further portion 49 which is recessed from a second edge 50 at the innermost end of the portion 48 to a third edge 51 closely adjacent the end plate 42 of the jaw element. The surface 49 thus provides a further receptacle with the cooperating surface of the opposed jaw element which is again generally cylindrical having either a smooth curved surface or stepped hexagonal shape surface for grasping larger elements such as bottles or cans. The whole of the surface 46 is roughened with transverse grooves to assist in grasping the materials to be collected.

Figure 4:
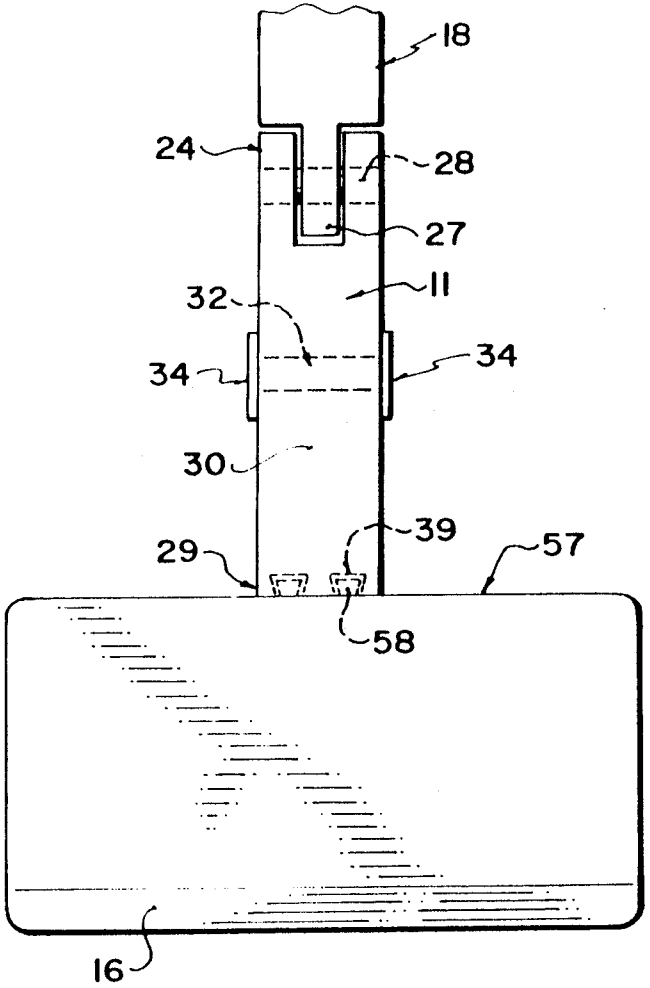
FIG. 4 is a side elevational view of the portion of the tool shown in FIG. 3.
Figure 3:
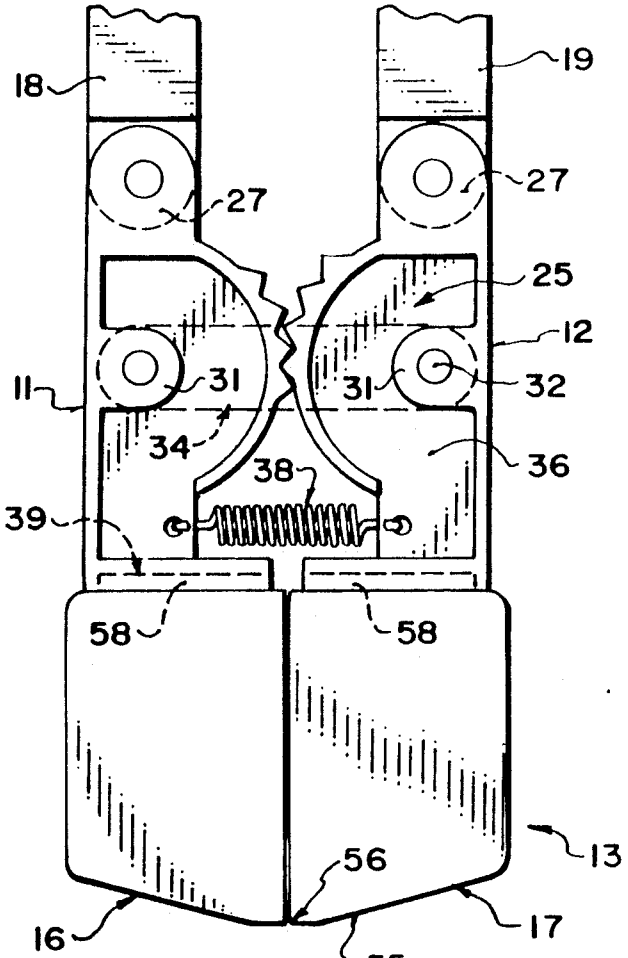
FIG. 3 is a front elevational view of the tool as shown in FIG. 1 and showing only the lower end of the handle.

The second style of jaw element is shown in FIGS. 1, 3 and 4 attached to the fulcrum members as previously described. In this case the jaw elements 16 and 17 are in the form of scoops which in the closed position shown in FIG. 3 substantially close around material to be lifted to fully contain and enclose that material. Each of the scoops is therefore generally rectangular in shape with a tapered outermost surface extending downwardly and inwardly as indicated at 55 to allow the device to be brought up to the material on the ground and then closed so the lip 56 grasps the material and lifts it into the container thus formed as the jaw elements close. The jaw elements include a backplate 57 similar to the plate 42 with frusto conical cross section projections 58 similar to those previously described for sliding into the grooves 39 in the end plate 29 of the fulcrum member.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A pickup tool comprising an elongate handle having an upper and a lower end, jaw means mounted at the lower end including first and a second jaw element and means coupling the jaw elements for relative movement in a direction transverse to a longitudinal extent of the handle for closing and opening movements of the jaw elements for grasping and releasing material to be picked up, and means movable on the handle for actuating said relative movement of the jaw elements, said movable means comprising two elongate sections of the handle each extending from the upper end to the lower end and coupled at the upper end such that squeezing of the handle sections at the upper end causes the lower ends of the handle sections to be forced together, fulcrum means interconnecting the lower end of a respective one of the handle sections to a respective one of the jaw elements such that said squeezing causes said opening movement of the jaw elements, and spring biasing means biasing said jaw elements to the closing movement, said fulcrum means comprises a pair of fulcrum elements each having one end thereof connected to a respective one of the handle sections for pivotal movement relative thereto and each having an opposed end thereof connected to the respective jaw element, the fulcrum members each having a cooperating rolling surface arranged such that the rolling surfaces of the elements are in engaging arrangement and pivot coupling means holding the fulcrum members together for pivotal movement about respective parallel axes.

2. The tool according to claim 1 including meshing gear teeth on the engagement surfaces of the fulcrum members.

3. The tool according to claim 1 wherein the spring biasing means comprises a tension spring coupled between the fulcrum members on a side of the engaging surfaces adjacent the jaw elements.

4. The tool according to claim 1 wherein each of the jaw elements is mounted on a respective one of the fulcrum members in a readily replacable manner, said jaw element and said fulcrum member having means thereon for readily releasable coupling therebetween.

5. The tool according to claim 4 wherein said readily releasable coupling means comprises a projecting portion on one of the jaw element and the fulcrum member and a channel on the other of the jaw element and fulcrum member whereby said coupling therebetween is obtained by sliding movement of the projection along the channel.

6. The tool according to claim 5 wherein the channel is arranged in a direction parallel to the opening and closing movement and wherein there is provided an abutment member limiting sliding movement of the jaw element in a direction outwardly of the fulcrum member such that the jaw element is attached to the fulcrum member while the fulcrum member is pivoted in a direction to cause said opening movement of the jaw element.

7. The tool according to claim 1 wherein each of the jaw elements includes a material engaging surface with the material engaging surfaces arranged to face one another for clamping the material therebetween, each material engaging surface including an abutment edge at an outer most location thereon for defining a narrow pinch line between the elements, a first recessed receptacle surface extending from the edge to a second edge closer to the handle and parallel to the abutment edge and a second recessed receptacle surface larger than the first surface and extending from the second edge to a third edge adjacent to the handle and parallel to the abutment edge, whereby a smaller article can be grasped between the first receptacle surfaces and a larger article can be grasped between the second surfaces.

8. The tool according to claim 7 wherein each of the first and second surfaces is substantially semi cylindrical.

* * * * *